US007318750B1

(12) United States Patent
Chacon et al.

(10) Patent No.: US 7,318,750 B1
(45) Date of Patent: Jan. 15, 2008

(54) APPARATUS FOR MANAGING MULTIPLE COMPUTERS WITH A CARTRIDGE CONNECTOR

(75) Inventors: Mauricio Chacon, Lakewood, CA (US); Jack Priebe, Palmyra, NY (US); Barry Sween, Santa Monica, CA (US); Yoko Iida, Los Angeles, CA (US); Dale Tadashi Honda, Torrance, CA (US)

(73) Assignee: Belkin International, Inc., Compton, CA (US)

( * ) Notice: Subject to any disclaimer, the term of this patent is extended or adjusted under 35 U.S.C. 154(b) by 0 days.

(21) Appl. No.: 11/608,763

(22) Filed: Dec. 8, 2006

(51) Int. Cl.
*H01R 33/90* (2006.01)

(52) U.S. Cl. ..... 439/638; 200/51.03; 361/681

(58) Field of Classification Search ..... 439/638, 439/639, 540.1, 52, 502, 76.1; 200/51.02, 200/51.03, 51.04, 51.05
See application file for complete search history.

(56) References Cited

U.S. PATENT DOCUMENTS 5,400,246 A * 3/1995 Wilson et al. ..... 700/17
5,406,450 A * 4/1995 Shieh ..... 361/686
5,424,903 A * 6/1995 Schreiber ..... 361/166
5,507,668 A * 4/1996 Lambrinos et al. ..... 439/502
5,596,479 A * 1/1997 Campbell et al. ..... 361/643
6,134,612 A * 10/2000 Bailey et al. ..... 710/62
6,747,878 B1 * 6/2004 Hipp et al. ..... 361/801
6,834,980 B2 * 12/2004 Okano et al. ..... 362/640
2003/0032333 A1 * 2/2003 Kwong ..... 439/638
2005/0047079 A1 * 3/2005 Gasbarro et al. ..... 361/686

* cited by examiner

*Primary Examiner*—Tulsidas C. Patel
*Assistant Examiner*—Vladimir Imas
(74) *Attorney, Agent, or Firm*—O'Melveny & Myers LLP

(57) ABSTRACT

A computer management apparatus is provided for interconnecting a user console including peripheral devices such as a keyboard, a video display unit, a mouse, and speakers for connecting to a plurality of host computers, selectively accessed via the user console ("KVMA cartridge"). The host computers interface with the KVMA cartridge via a removable edge connector with a first set of cables that attach to the plurality of host computers. The KVMA cartridge connects to the edge connector via a leading edge of a circuit board having a plurality of traces on the leading edge with electrical leads connected to a switching circuit within the KVMA cartridge. In one embodiment, the user may increase the length of the first set of cables by inserting an extension cartridge with a second set of cables between the KVMA cartridge and the edge connector with the first set of cables.

57 Claims, 6 Drawing Sheets

APPARATUS FOR MANAGING MULTIPLE COMPUTERS WITH A CARTRIDGE CONNECTOR

BACKGROUND OF THE INVENTION

1. Field of the Invention

The present invention relates generally to computer systems, and more particularly to an apparatus for using or accessing a plurality of host computers by using a PCB card edge connector to connect to the host computers.

2. Description of Related Art

In many applications, it is advantageous to interconnect a single computer to multiple computers. For example, a keyboard/video/mouse ("KVM") switch is a device that is generally connected to multiple computers ("host computers") in order to enable a single keyboard, video display monitor and mouse (the "user console") to control each of the connected computers. Similarly, there also exists an enhanced version called a keyboard/video/mouse/audio ("KVMA") switch that includes the ability to enable a single set of speakers to be selectively routed to each of the connected computers. In this way, a user may have access to multiple host computers without having to deal with the clutter and space requirements of having separate keyboard, monitor, and mouse for each of the computers. When the user accesses a host computer connected to the KVMA switch, video signals are routed from the computer, processed, and displayed on the single video monitor. Generally, to access another host computer, the user either physically actuates buttons or other mechanisms on the body of the KVMA switch. Some KVMA switches utilize software switching, wherein software is loaded on all of the host computers and a user selects an active host computer by pressing a combination of keys on the keyboard and/or clicking buttons on the mouse of the user console.

Regardless of the method of selecting the active host computer, there are many cables and wires for a computer user to connect between the KVMA switch and the host computers, as well as the cables for the interface devices. In particular, the cables that connect each host computer to the KVMA switch can include: a video cable, cursor control signal cable, a keyboard control signal cable, and audio out signal cable. Accordingly, with each host computer added to the KVMA switch, four additional cables are needed (three if USB type connectors are used). This can make things complicated for the non-technically savvy individual both when she initially sets-up a KVMA switch and if the user later wants to move a host computer or add additional ones.

One approach to simplify the setup of a KVMA switch utilizes a set of host computer cables integrated into the KVMA switch base, so that there are no connectors for the user to hook-up on one end of the host computer cables, as they simply extend from the KVMA switch base ("extending cables"). This approach does simplify the set-up of the KVMA switch for the user; however, there are several drawbacks to this approach. First, because the length of the extending cables is fixed by the manufacturer of the KVMA switch, the length can not be altered by the user. The manufacturer could offer the KVMA switch with several lengths of cables, but that would create excess inventory to deal with and the potential users would be forced to make a choice and stick with it for the life of the product. Second, if the user wants to later move one of his or her host computers to a different location, there is no way to lengthen or shorten the cables (short of hiring a technician to splice the cables—an expensive and inefficient approach that will likely causes signal loss and/or introduce noise into the cables as well). Third, a particular embodiment of the KVMA switch can control up to say four computers and the user only wants to control three, there will be an extra length of unused bulky cable to leave dangling from the KVMA switch.

Another approach to simplify the setup of a KVMA switch reduces the number of connectors attached from the KVMA body or housing to each host computer controlled by the KVMA switch, by combining the video signal, cursor control signal, and keyboard control signal cables into one video signal connector. This can be accomplished by utilizing the extra connection pins in the industry standard DB15 video signal connector utilized with video signals transmitted under the video graphics array ("VGA") standard. A separate connector is still required for the audio out signal cable for each host computer. The use of the combined video signal, keyboard signal and cursor control signals into one custom designed, non-standard connector for each host computer does significantly reduce the number of cables and connectors required for hooking-up each host computer to the KVMA switch body, so that two connectors are required to control each host computer with the KVMA switch, thereby improving the ease of set-up for users, but there is still room for further improvement.

It is desirable, therefore, to provide a KVMA switch that is easy and quick to set-up, preferably having only one cable and connector that needs to be connected to the KVMA switch housing. Such an apparatus can have the added benefit of avoiding the introduction of noise and signal loss into the signal paths by minimizing the signal path length and the number of discrete internal connection wires utilized in attaching the host computers to the KVMA switch body. Additionally, such an apparatus could reduce the cost to the manufacturer, wholesaler, distributor, and to the end user.

SUMMARY OF THE INVENTION

A computer management apparatus is provided for interconnecting a user console including peripheral devices, such as a console keyboard, a console video display unit, a console mouse, and speakers for connecting to a plurality of host computers, selectively accessed via the user console ("KVMA cartridge"), wherein the host computers interface with the KVMA cartridge via a single removable edge connector with a first set of cables that attach to the plurality of host computers. The KVMA cartridge connects to the edge connector via a leading edge of a circuit board having a plurality of traces on the leading edge with electrical leads connected to a switching circuit within the KVMA cartridge.

In another embodiment, the user may change the length of the first set of cables by adding an extension cartridge with a second set of cables to the KVMA cartridge. The extension cartridge is connected between the KVMA cartridge's leading edge and the edge connector with the first set of cables. This allows the user to lengthen the total cable length from the KVMA cartridge to the host computers with just one additional cable and connector on each end.

In another embodiment of the present invention, the KVMA cartridge connects to the plurality of host computers through a hub unit. The KVMA cartridge has a first leading edge that extends from a KVMA cartridge housing and connects to a first edge connector mounted on a hub unit housing. The plurality of host computers connect directly to the hub unit housing by a first set of computer cables with a plurality of plugs. The switching circuit contained within the KVMA cartridge selectively connects the user console to the input and output signals of one of the host computers selected by the user.

In yet another embodiment of the present invention, the first set of computer cables corresponds to a first color code and the and the second set of computer cables corresponds to a second code. The edge connector comprises an edge interface that identifies the first set of computer cables with the first color code and the second set of computer cables with the second color code. The KVMA cartridge has an indicator that indicates the first color code when a set of connector ports are connected to the first set of computer cables and the second color code when the set of connector ports are connected to the second set of computer cables.

A more complete understanding of the apparatus for enabling a single user console manage, control, and view a plurality of host computers utilizing a KVMA cartridge that interfaces with a plurality of host computers via a single interlocking connector will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides an apparatus for accessing a plurality of host computers from a user console and allowing a user to selectively switch signals including keyboard, video signal, mouse and audio signals, from each of the host computers with a KVMA switch utilizing a cartridge design ("KVMA cartridge") that interfaces with a plurality of host computers via a single interlocking connector. In the detailed description that follows, like element numerals are used to indicate like elements appearing in one or more of the figures.

Figure 1:
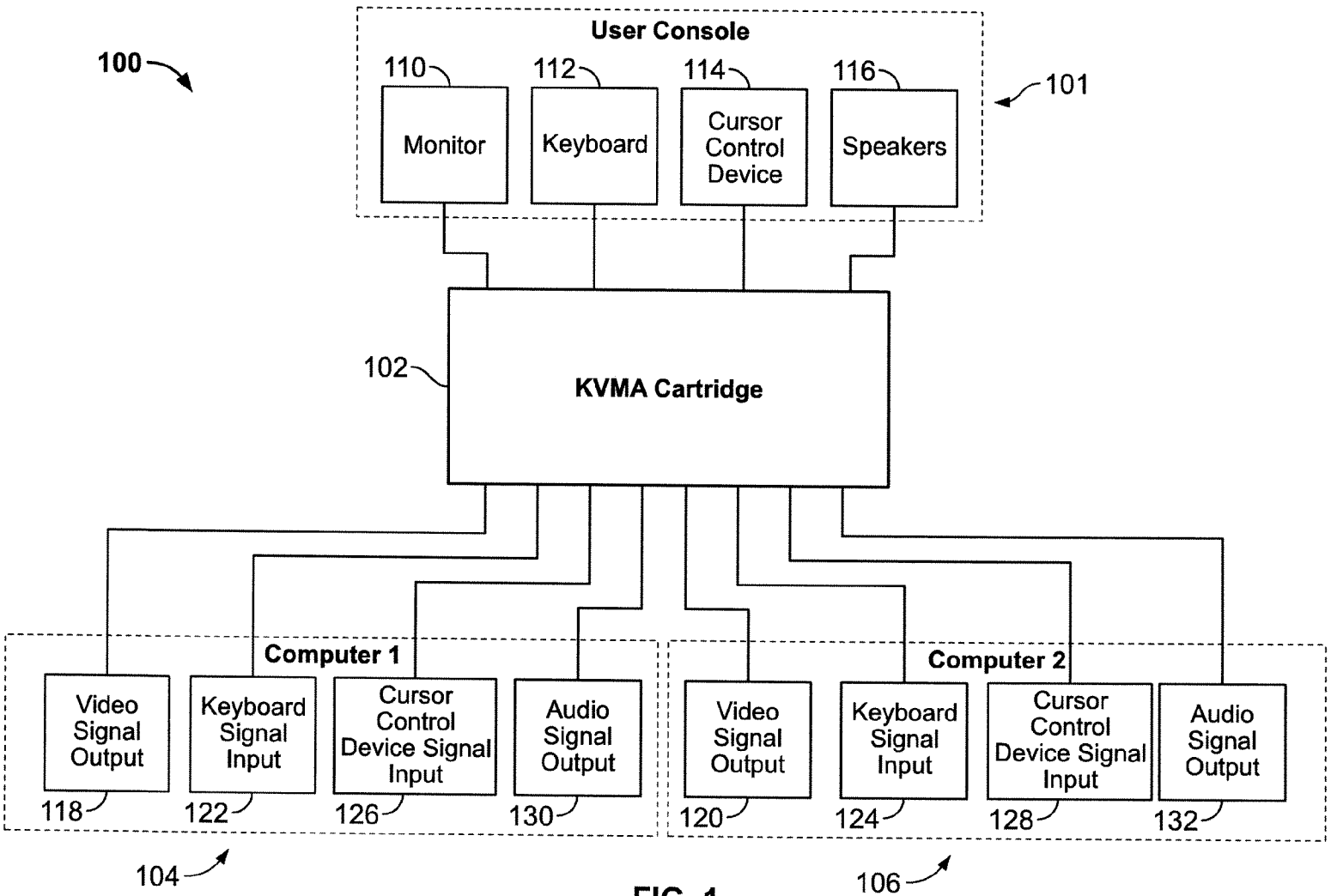
FIG. 1 is a block diagram showing an exemplary computer management apparatus utilizing a KVMA cartridge.

FIG. 1 shows a block diagram of an exemplary system for a keyboard, video, mouse, audio (KVMA) switch apparatus utilizing a cartridge that provides convenient and intuitive switching between two computers. The cartridge comprises a housing, containing a circuit board with a leading edge of the circuit board protruding from the housing. Also contained within the housing is internal circuitry and connector ports that interface to external peripherals protruding from the housing. More complete details on the operation of the KVMA cartridge follow below.

In one embodiment of the invention, computer management system 100 comprises a computer management apparatus or KVMA cartridge 102 that is connected between a user console 101 and host computers 104 and 106. The user console 101 has input devices comprising a console keyboard 112 and a console cursor control device 114. The user console 101 also has output devices comprising a console video display monitor or display device 110 and console speakers or audio devices 116. The KVMA cartridge 102 processes signals from the console keyboard 112 and the console cursor control device 114 for use by the appropriate host computer 104 or 106 selected by the user, such that the cursor control device signal inputs 126 and 128 and the keyboard signal inputs 122 and 124, respectively, are routed to the appropriate host computer.

Similarly, the KVMA cartridge 102 processes the audio signal outputs 130 and 132, as well as the video signal outputs 118 and 120 from the host computers 104 and 106, such that audio signal outputs 130 and 132 and video signal outputs 118 and 120 respectively, from the appropriate host computer selected, may be heard on speakers 116 and displayed on the console video display monitor 110. Audio and video signals are transmitted through the system 100 from the host computers 104 and 106 to the console 101. Collectively, the video signal outputs 118 and 120, the audio signal outputs 130 and 132, the keyboard signal inputs 122 and 124, and the cursor control device signal inputs 126 and 128, will be referred to as the "host computer peripheral signal inputs and outputs" herein.

Generally, existing video display monitors such as the console video display monitor 110, can receive analog video signals (such as those transmitted under the video graphics array ("VGA") standard), digital video signals (such as those transmitted under the digital video interface-integrated ("DVI-I") standard), or both. Such video monitors can also include a display data channel to transmit monitor information, in accordance with the Video Electronics Standards Association (VESA) DDC2B standard, as selected by the user by use of the remote switch 108*a*.

Figure 2A:
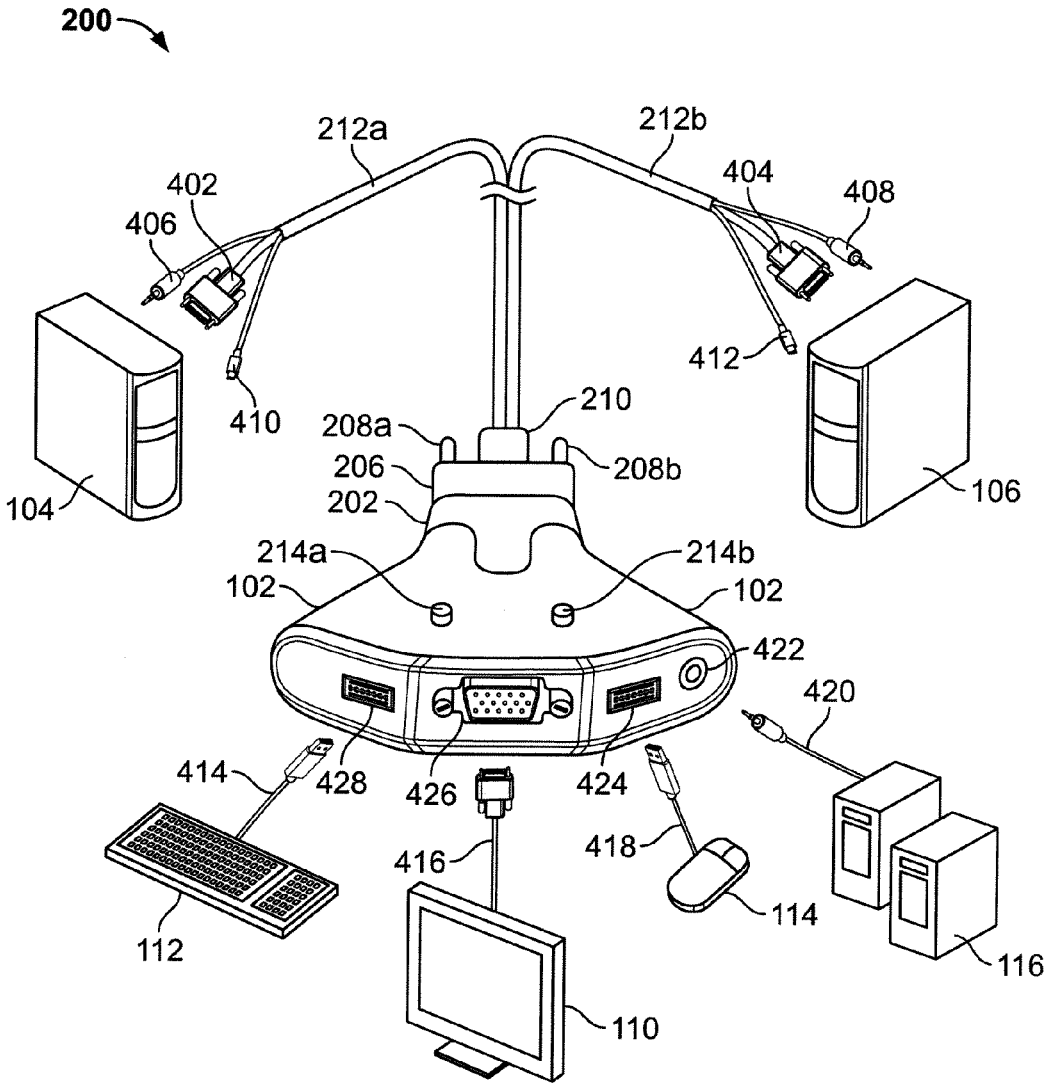
FIG. 2A shows one embodiment of a system utilizing an exemplary KVMA cartridge, illustrating the computer cables, connectors, plugs, and peripherals that interconnect to the KVMA cartridge.

FIG. 2A shows a computer management system 200 comprising a KVMA cartridge with USB connectors and illustrating the cables, connectors and peripherals comprising the user console 101 (shown in FIG. 1) that manages, controls and views the host computers 104 and 106. Additionally, FIG. 2A illustrates the computer cables that attach to the two host computers controlled by the KVMA cartridge 102 via a card edge connector with a connector cover 206.

As illustrated in FIG. 2A, the connector cover 206 and a cover 202 abut each other. An edge connector 204 (shown in FIGS. 3A and 3B) is partially surrounded by the connector cover 206. A leading edge 222 (shown in FIGS. 3A and 3B) partially surrounded by the cover 202. The edge connector 204 and the leading edge 222 are mated to each other. The edge connector 204 protrudes from the connector cover 206 into the cover 202 and surrounds the leading edge 222 so as to not be visible in FIG. 2A. The edge connector 204 is held securely in attachment with the leading edge 222 by thumb screws 208*a* and 208*b*. In the embodiment, the various connectors on the KVMA cartridge 102 that are electrically coupled to peripherals comprising the user console 101 (shown in FIG. 1) are illustrated. Also shown in FIG. 2A are computer cables 212*a* and 212*b* on the distal end of the KVMA cartridge 102 that are electrically connected to the host computers 104 and 106, respectively, by a plurality of connector plugs (discussed further below).

The computer cables 212*a* and 212*b* are molded together and run side-by-side in parallel along a portion of their respective lengths beginning at the proximal end protruding from a connector cover 206 and split apart at the distal end to connect the computer cables 212*a* and 212*b* to the host computers 104 and 106, respectively. The cables at some point split apart since the host computers 104 and 106 are physically separated from each other in most situations as illustrated in FIG. 2A.

FIG. 2A illustrates the cables and connectors that attach to both ends of the KVMA cartridge 102. The following exemplary connectors that are operatively connected to various connector ports (discussed with regards to FIGS. 3A and 3B below) are illustrated: connectors 428 and 424 are USB type A connectors, a connector 426 is a VGA compatible, 15-pin mini D-SUB connector, and a connector 422 is a stereo ⅛" (3.5 mm) mini-jack. The console keyboard 112 is electrically coupled to the connector 428 by a keyboard cable 414 with a keyboard connector plug on one end; the console video display monitor 110 is electrically connected to the connector 426 by the video cable 416 with a video connector plug on one end; the cursor control device 114 is electrically connected to the connector 424 by a cursor control cable 418 with a cursor control plug on one end; and the console speakers 116 are electrically connected to the connector 422 by an audio cable 420 with an audio connector plug. In other words, each of the user console peripheral devices operatively connect to the connector ports by the foregoing connector plugs and is selectively connected to the host computers 104 and 106 by the user depressing selector buttons 214*a* or 214*b*, respectively. It should be appreciated that other types of industry standard connectors can be utilized in other embodiments of the present invention, such as the connector 426 may comprise a DVI-I connector instead of a 15-pin mini D-SUB connector and the connectors 428 and 424 may comprise PS/2 type connectors.

In this exemplary embodiment, computer cables 212*a* and 212*b* extend out of the distal end of the KVMA cartridge 102 and have identical plugs on the ends that attach to host computers 104 and 106, respectively. Connectors 402 and 404 are video connector plugs that allow the video out signals 118 and 120 to be electrically coupled to computer cables 212*a* and 212*b*, respectively. Similarly, audio connector plugs 406 and 408 allow the audio out signals 130 and 132 to be electrically coupled to computer cables 212*a* and 214*b*; and USB connector plugs 410 and 412 that function as both keyboard connector plugs and cursor control connector plugs are electrically coupled to both the keyboard inputs or keyboard signal inputs 122 and 124, as well as to the cursor control device signal inputs 126 and 128. In effect, the KVMA base 102 acts as a switched USB hub with regard to selectively coupling the USB connector plugs 410 and 412 to the connectors 428 and 424, when the user selects the host computer 104 or 106 with the selector buttons 214*a* and 214*b*.

In FIG. 2A, the console video display monitor 110 can be any display device such as a liquid crystal display ("LCD"), cathode ray tube ("CRT"), or a plasma display with a VGA compatible, 15-pin mini D-SUB connector or a DVI-I connector (also, the DVI-D or DVI-A DVI connector types) developed by an industry consortium, the Digital Display Working Group ("DDWG"). The present invention can be modified to operate with any industry standard compatible display monitor. The console speakers 116 can be any industry standard type computer speakers and allow the user to hear the audio signal outputs 130 or 132 that correspond to the host computers 104 and 106, selected by the user via the KVMA remote control 108*a*. The user selects the state or mode of a switching circuit (not shown) within a body of the KVMA cartridge 102. The console cursor control device 114 is illustrated as a computer mouse in FIG. 2A; however, one skilled in the art will realize that console cursor control device 114 can be embodied by other known human interface devices such as a trackball or touchpad.

In the exemplary embodiment illustrated in FIGS. 2A, the KVMA cartridge 102 has a unique compact triangular shape and is connected to host computers 104 and 106 via computer cables 212*a* and 212*b*, respectively. In other embodiments, the KVMA cartridge 102 has other shapes and sizes with the connectors and cables located in different areas of the KVMA cartridge 102.

Figure 2B:
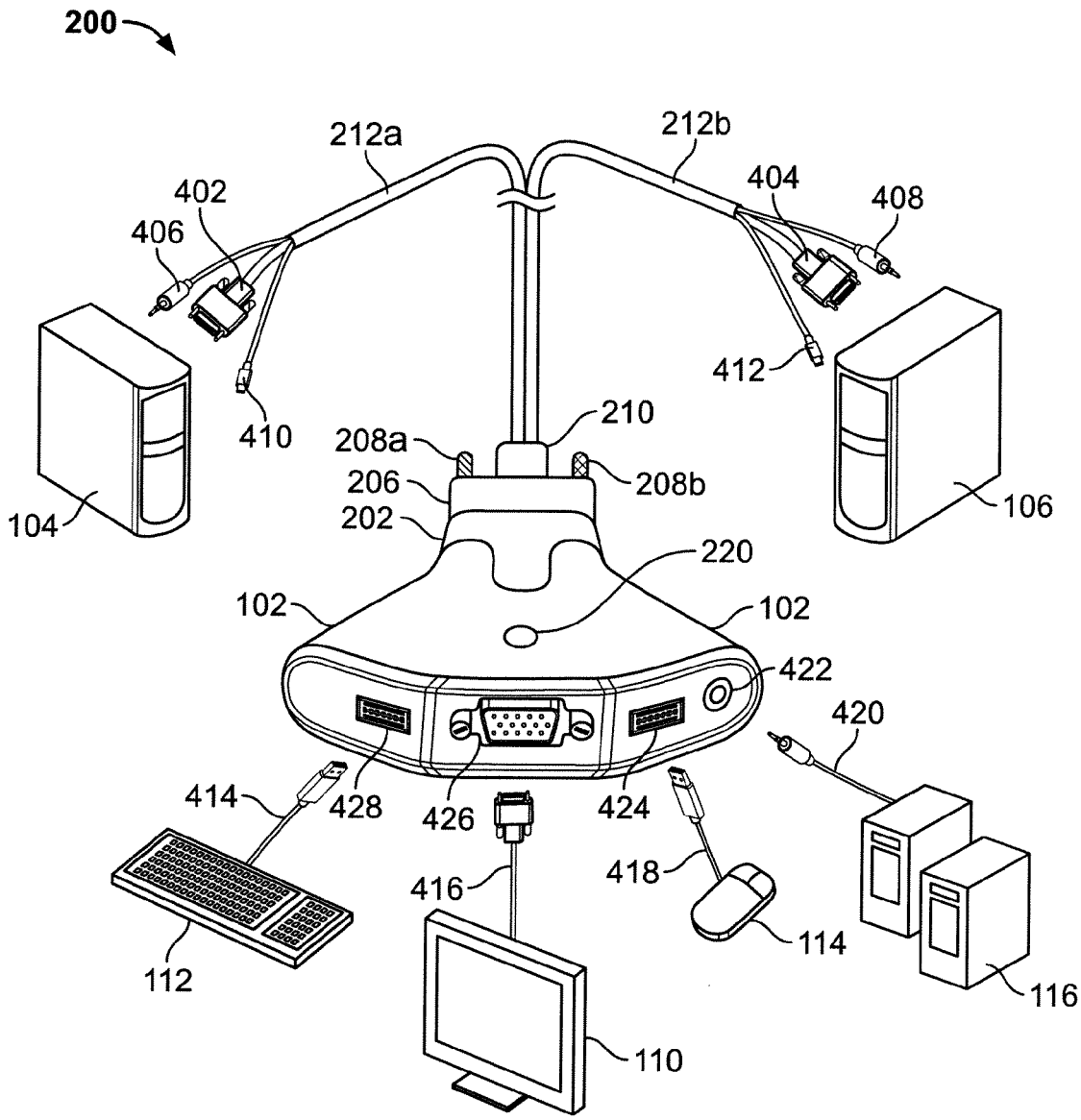
FIG. 2B shows one embodiment of a system utilizing an exemplary KVMA cartridge that incorporates color coding of the computer cables, illustrating the computer cables, connectors, plugs, and peripherals that interconnect to the KVMA cartridge.

FIG. 2B illustrates another embodiment, wherein the cables and connectors that attach to both ends of the KVMA cartridge 102 in another embodiment that incorporates color coding of the computer cables to correspond to the host computer selected by the user. In particular, the thumb screws 208*a* and 208*b* are each colored differently (such as yellow and green). in FIG. 2B, selector buttons 214*a* and 214*b* do not appear in the figure. Instead, each of the user console peripheral devices operatively connected to the connector ports (discussed with regards to FIGS. 3A and 3B below) is selectively connected to the host computers 104 and 106 by the user depressing an activation button (not shown) on a remote control device (not shown). The remote control can be operatively connected to the KVMA cartridge 102 by a cable with a plug attached to a connector port on the KVMA cartridge 102 or other by other means such as by wireless communication protocols. In other variations of this embodiment, the remote control device has other types of activation mechanisms to select between the host computers 104 and 106.

The KVMA cartridge can optionally have a multi-colored light emitting diode ("LED") indicator 220 that emits two different colors (such as yellow and green) to indicate when host computer 104 or 106 is selected by the user. The remote control device can have a multi-colored LED indicator (not shown) that emits two different colors (such as yellow and green) corresponding to the two colors of the LED 220 that light up when the user selects one of the host computers 104 or 106 with the activation button on the remote control device. One of skill in the art Will recognize that the features and functions of the LED can vary within the spirit and scope of the invention.

In addition to the colored thumb screws 208*a* and 208*b*, in the embodiment of FIG. 2B, the thumb screws on the connectors 402 and 404 can optionally be color coordinated with the thumb screws 208*a* and 208*b*. That is, the thumb screws of connector 402 are the same color as the thumb screw 208*a* and the thumb screws of connector 404 are the same color as the thumb screw 208*b*. One skilled in the art will recognize that other variations of providing color identification of the host computers 104 and 106 can be accomplished such as by a first colored silk screening on one portion of connector cover 206 and a second colored silk screening on a second portion of connector cover 206. The first colored silk screening and the second colored silk screening would than correspond to the two colors of some portion of connectors 402 and 404, respectively. In such a variation of this embodiment, the indicator 220 and the indicator on the remote control device can have the same first color and second color as connector cover 406, and connectors 402, 404, such that that the first color and second color alternate when the activation button or other activation mechanism is used to select between the host computers 104 and 106.

In yet another variation of the embodiment shown in FIG. 2B, the user selectively connects the connector ports to the host computer 104 and 106 by use of keyboard commands (not shown) entered on the console keyboard 112. The user installs or loads a software program on the host computers 104 and 106 to enable/activate the selective switching of the connector ports of the KVMA cartridge 102 by use of the keyboard commands. The keyboard commands can be a sequence of a plurality of different keys ("Hot Keys") on the console keyboard 112 that the user can assign to a particular combination. In one embodiment, the user can use one or more Hot Keys to toggle between the video signal output 118, keyboard signal input 122, cursor control device signal input 126, and audio signal output 130 of a first host computer and the video signal output 120, keyboard signal input 124, cursor control device signal input 128, and audio signal output 132 of a second host computer (shown in FIGS. 1A and 1B). In another embodiment, the user can use one or more Hot Keys to select between: the video signal outputs 118 and 120; keyboard signal inputs 122 and 124; cursor control device signal inputs 126 and 128; audio signal outputs 130 and 132; or any combination thereof. Furthermore, it will be understood that the color coding schemes described herein can be modified or expanded upon to accommodate the various combinations of video signal outputs 118-120, keyboard signal inputs 122-124, cursor control device signal inputs 126-128, and audio signal outputs 130-132, that can be achieved with the Hot Keys.

Figure 3A:
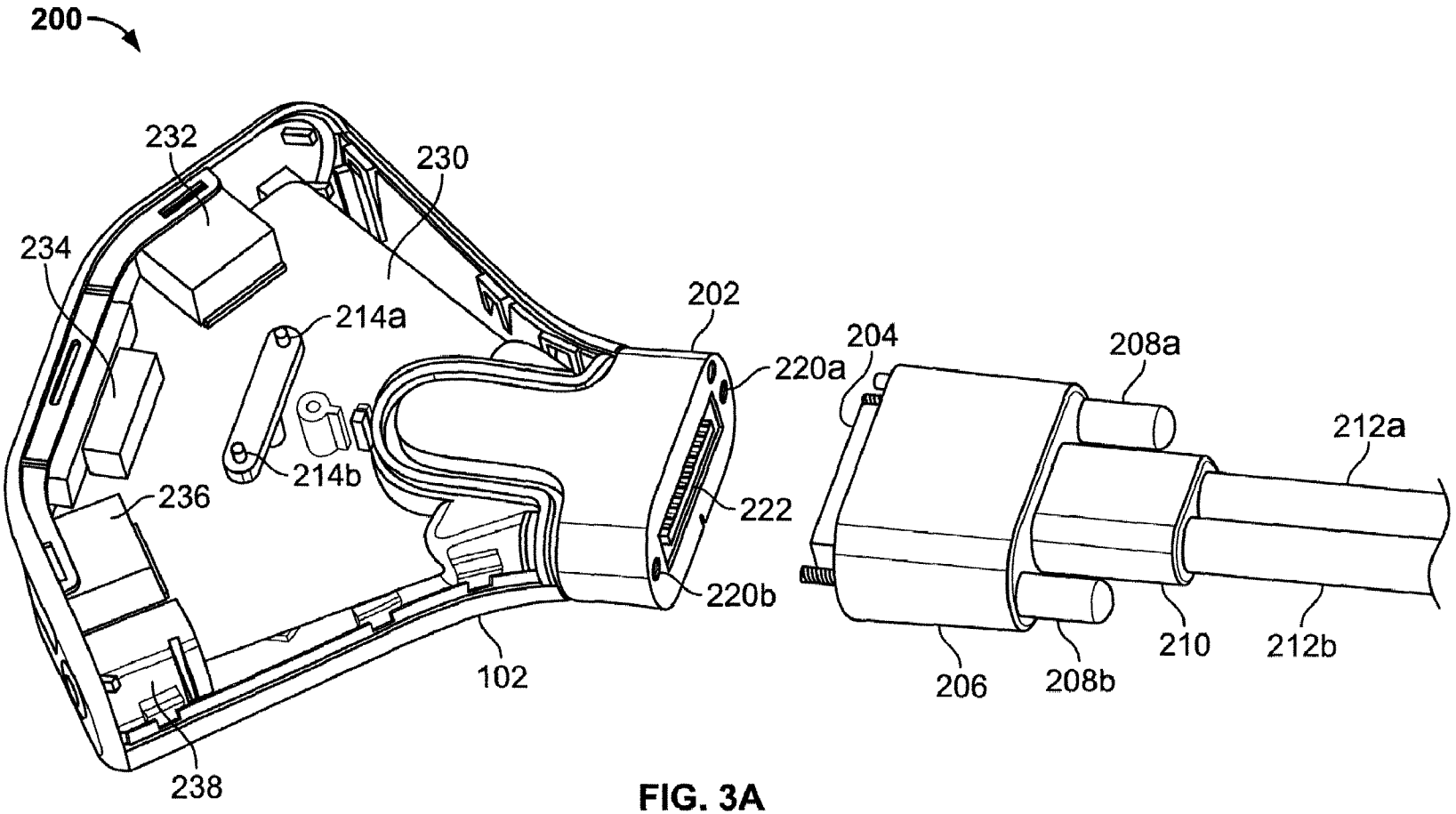
FIGS. 3A and 3B provide perspective views of an exemplary embodiment of a KVMA cartridge with the cover removed.
Figure 3B:
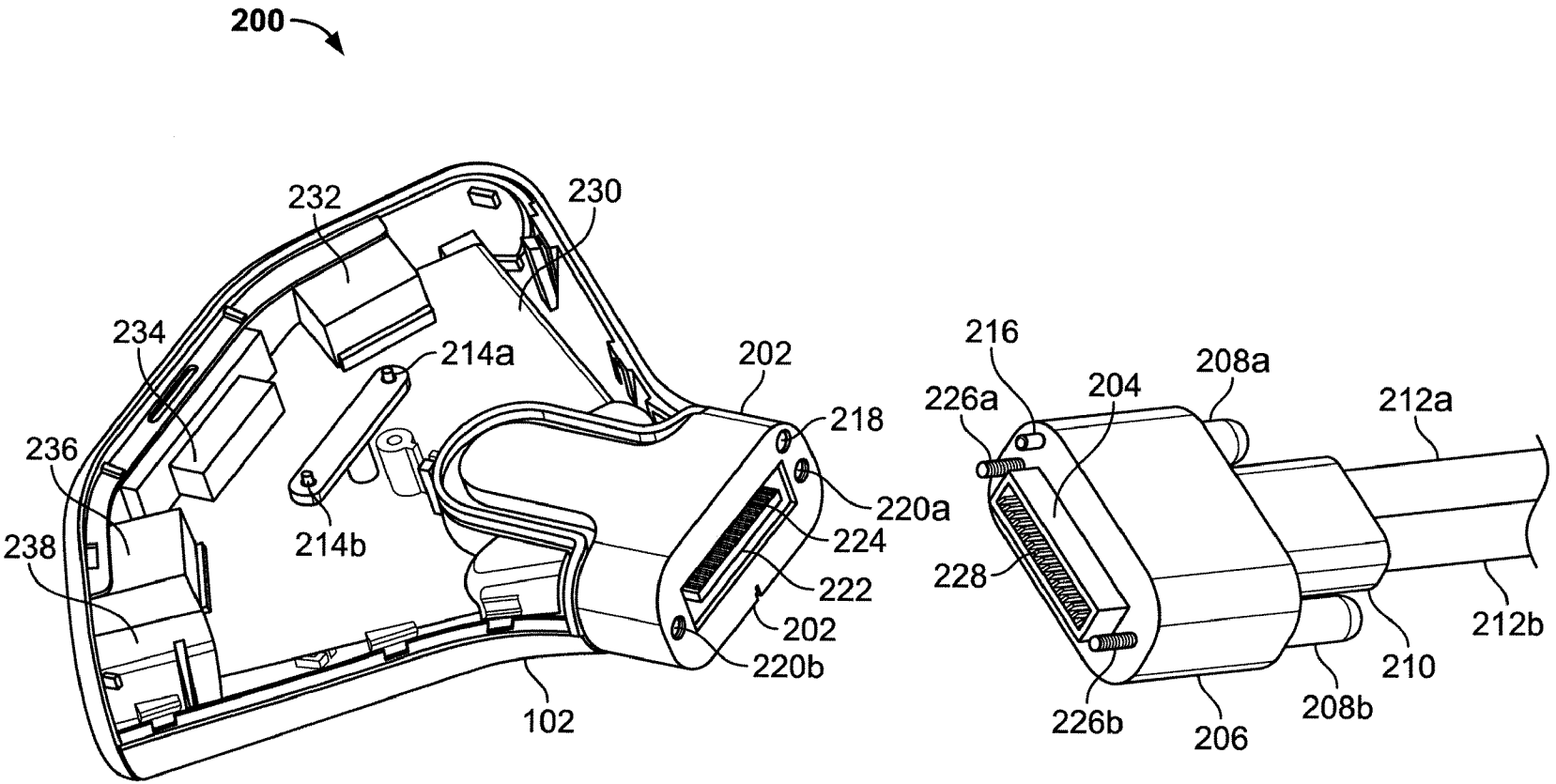

FIGS. 3A and 3B provide perspective views of an exemplary embodiment of a KVMA cartridge with the cover removed, illustrating the use of a PCB card edge connector to communicate with two host computers. In this embodiment, the computer management system 200 comprises the KVMA cartridge 102 and the card edge connector 204 attached to the computer cables 212*a* and 212*b*. The KVMA cartridge 102 interfaces with the user console computer 101 (shown in FIG. 1) via a keyboard port 232, a video port 234, a cursor control port 236, and an audio port 238 (collectively "connector ports"). The connector ports operatively connect to the two host computers 104 and 106 (shown in FIGS. 2A and 2B) through a cartridge interface (not shown) comprising a cover 202, a circuit board 230, a leading edge 222, wherein the cartridge interface at least partially surrounds the leading edge 222 with the non-surrounded portion being part of the external circuitry (not shown) of the KVMA cartridge 102.

The KVMA cartridge 202 further comprises a switching circuit (not shown), selector switches or selector buttons 214*a* and 214*b*, a housing (not shown), and a circuit board. The switching circuit is a component of the internal circuitry (not shown) of the KVMA cartridge 102. The cartridge interface further comprises a plurality of traces 224, electrical leads (not shown), threaded inserts or receptacles 220*a* and 220*b*, and a socket or receptacle 218. The cartridge interface removably connects to an edge interface (not shown) that includes a printed circuit board ("PCB") edge connector or edge connector 204 that includes a slot with contacts 228, and computer cables 212*a* and 212*b*. The edge connector 204 is protected by a connector cover 206 that comprises a strain relief 210, threaded thumb screws 208*a* and 208*b* protruding from the end of the connector cover 206 proximate to the strain relief 210, and screw threads 226*a* and 226*b* proximate to the edge connector 204, and a protrusion or placement pin 216.

Looking closer now at the details of this exemplary embodiment, KVMA cartridge 102 is operatively connected to the peripheral devices that comprise the user console 101, e.g., the console video display monitor 110, console keyboard 112, console cursor control device 114, and console speakers 116 (illustrated in FIGS. 1 and 2), via connector ports 232, 234, 236 and 238, respectively. In the exemplary embodiment, these peripheral devices interface with the connector ports by connectors 422-428 (shown in FIG. 2A and discussed in detail above). More specifically, the keyboard port 232 is operatively connected to the connector 428; the video ports 234 is operatively connected to the connector 426; the cursor control port 236 is operatively connected to the connector 424; and audio port 238 is operatively connected to the connector 422. It should be appreciated by one skilled in the art that the connector ports can interface with the user console 101 peripheral devices by a variety of different types of connectors.

In operation, the user selects or toggles between the host computers 104 and 106 (shown in FIGS. 2A and 2B) by depressing selector buttons 214*a* and 214*b*. This in turn causes the switching circuit mounted on the circuit board 230 to selectively connect the host computer peripheral signal inputs and outputs to the connector ports 232-238 and ultimately to the user console 101 (shown in FIG. 1). The computer peripheral signal inputs and outputs communicate with the KVMA cartridge 202 through the cables 212*a* and 212*b* that are removably connected to the switching circuit via the edge interface that includes edge connector 204. The edge connector 204 interlocks with the leading edge 222 when it mates with the socket with contacts 228 by the user turning the threaded thumb screws 208*a* and 208*b* so that the screw threads 226*a* and 226*b* engage the threaded inserts 220*a* and 220*b*. In this embodiment, the connector cover 206 includes the placement pin 216 that mates with the socket 218 on the cover 202 to both guide the edge connector 204 into the proper position to engage the leading edge 222 and to assist in aligning and holding the edge connector and the leading edge 222 together until the threaded thumb screws 208*a* and 208*b* are tightened into the threaded inserts 220*a* and 220*b*.

The host computer peripheral signal inputs and outputs are coupled to the switching circuit through the plurality of traces 224 that are etched or bonded onto the leading edge 222 and the plurality of traces 224 comprise electrical leads that electrically connect the signal inputs and outputs to the switching circuit. The leading edge 222 and the circuit board 230 are one continuous surface with the leading edge being a part of the circuit board 230 that partially extends out of the cover 202 and the balance of the circuit board 230 contained within the internal portion of the housing.

A benefit to the present invention is the use of the edge connector 204 with a set of computer cables 212*a* and 212*b* that connect the plurality of host computers 104 and 106 to the KVMA cartridge 102 with just one connector on the outside portion of the housing of the KVMA cartridge. This simplifies the set-up of the KVMA cartridge 102, reduces clutter, and reduces the manufacturing cost as compared to conventional KVMA switches both in terms of reduced parts count and reduced labor to manufacture the apparatus. Additionally, by connecting the computer cables 212*a* and 212*b* from the plurality of host computers 104 and 106 directly to the circuit board 230 by the single edge connector 204, the potential for signal loss and the introduction of noise into the signal paths is reduced. A further benefit is the ability to eliminate extra unused computer cables left dangling from the KVMA cartridge 102 when the user wishes to hook-up and control a lesser number of host computers than the switching circuit within the KVMA cartridge 102 is capable of handling.

Figure 4:
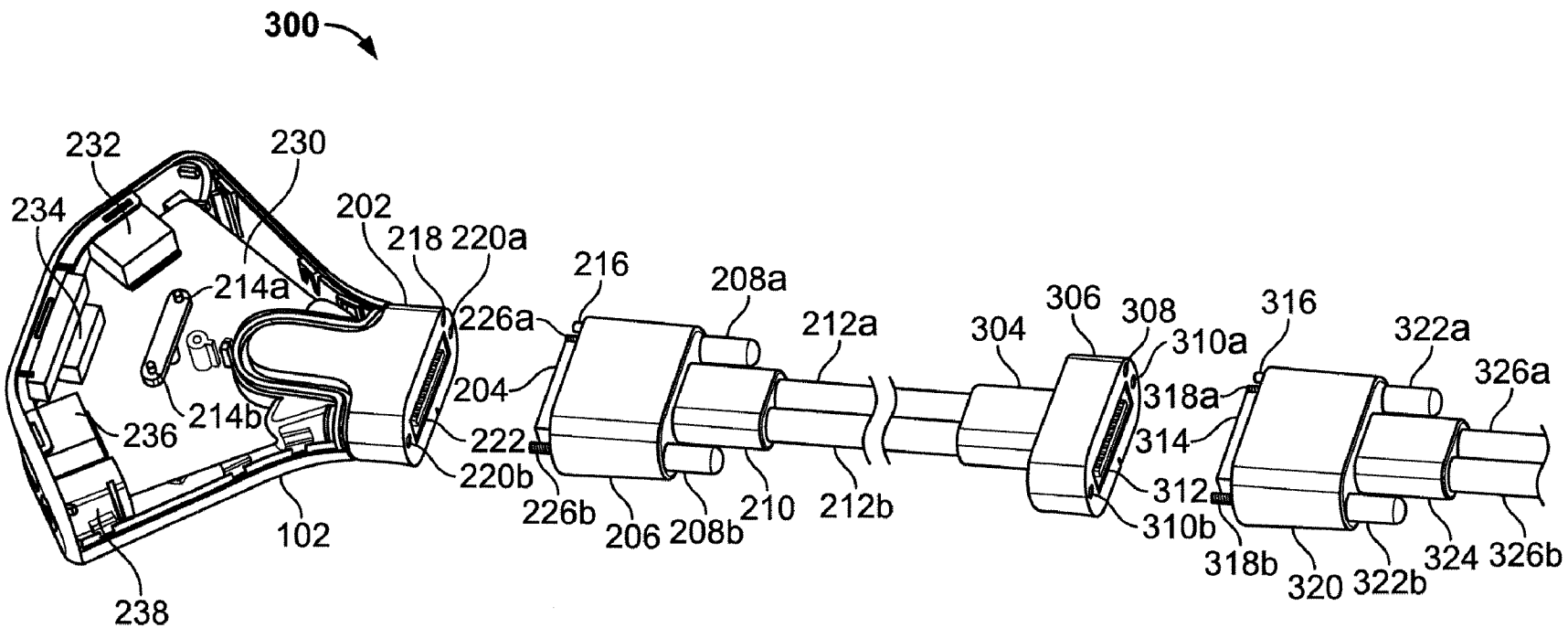
FIG. 4 provides a perspective view of another embodiment of a KVMA cartridge with an extension cable to communicate with two host computers.

FIG. 4 provides a perspective view of a KVMA cartridge illustrating the use of a card edge connector with an extension cable to communicate with two host computers, in accordance with another embodiment. The computer management system 300 comprises components illustrated in the embodiment of FIGS. 3A and 3B and described above, but with additional components including an extension cartridge (not shown) that allows the user to easily alter the total cable length of the computer cables 212*a*, 212*b*, 326*a* and 326*b* that extend from the KVMA cartridge 102 to the plurality of host computers 104 and 106 after initial installation and set-up if one or more host computers is later added or one of the host computers 104 or 106 is moved to another location. As with the embodiments discussed earlier, the user of the KVMA cartridge 102 selects the host computer 104 or 106 (shown in FIGS. 2A and 2B) she desires to operatively couple to the user console 101 (shown in FIG. 1) by depressing selector buttons 214*a* or 214*b* on the body of the KVMA cartridge 102. Other activation mechanisms for selecting the active host computer are within the spirit and scope of the present invention.

The extension cartridge comprises an extension strain relief 304, an extension cartridge cover 306, an extension socket or receptacle 308, extension threaded inserts 310*a* and 310*b*, an extension leading edge 312 and an extension circuit board (not shown). Other components illustrated in this embodiment are: an extension connector 314, an extension pin or protrusion 316, extension screw threads 318*a* and 318*b*, an extension connector cover 320, extension threaded thumb screws 322*a* and 322*b*, an extension strain relief 324, and extension cables 326*a* and 326*b*. The extension cables 326*a* and 326*b* are similar to computer cables 212*a* and 212*b* in that extension cables 326*a* and 326*b* extend outward from the extension connector 314. The extension cables 326*a* and 326*b* have a plurality of connector plugs on their distal ends (not shown) that connect to host computers 104 and 106 (shown in FIGS. 2A and 2B). The extension leading edge 312 is a continuous portion of an extension circuit board (not shown) contained within the extension connector cover 306. The extension connector 314 comprises an extension slot (not shown) that allows the extension connector 314 to mate with the extension leading edge 312. The function and operation of these additional components is essentially the same as those similar appearing components 202-212*b* described above with regard to FIGS. 3A and 3B.

In another embodiment of the present invention (not shown), a KVMA cartridge connects to a plurality of host computers through a hub unit. The KVMA cartridge has a leading edge extending from the housing that operatively connects to an edge connector mounted on a hub unit housing. In a variation of this embodiment, a plurality of KVMA cartridges operatively connect to a plurality of edge connectors mounted on the hub unit. In both of these embodiments, the plurality of host computers connect directly to the hub unit with a first set of computer cables, wherein the first set of computer cables comprise a card edge connector that operatively connects to a leading edge extending from the hub unit housing. In a variation of these two embodiments, the plurality of host computers have a plurality of computer cables operatively connected to the hub unit by a plurality of connectors extending from the exterior of the hub unit. In all of these embodiments, the input and output signals of the host computers are operatively connected to the user console via internal circuitry of the hub unit. The switching circuit contained within the KVMA cartridge selectively connects the user console to the input and output signals of one of the host computers selected by the user.

In yet another embodiment of the present invention (not shown), a KVMA cartridge has a first set of computer cables extending from a first leading edge of the KVMA cartridge. The first leading edge connects to the first set of computer cables by a first card edge connector that in turn has a second card edge connector on the opposite end of the first set of computer cables. The second card edge connector operatively connects to a second leading edge extending from a hub unit housing. The plurality of host computers then connect directly to the housing of the hub unit by a second set of computer cables that attach to one or more connectors mounted on the housing of the hub unit. The second set of computer cables operatively connect input and output signals of the host computers to the hub unit and the switching circuit contained within the KVMA cartridge selectively connects the user console to one of the host computers selected by the user.

One advantage to this embodiment is that the hub unit can be placed a relatively large distance from the plurality of host computers with just a single set of connectors and a single set of computer cables running between the hub unit and the KVMA cartridge and a conventional set of connectors with relatively short separate corresponding cables and plugs attached to each of the plurality of host computers.

Having thus described a preferred embodiment of an apparatus for accessing a plurality of host computers from a single console and allowing the user to selectively access the user console, wherein the host computers interface with the management apparatus via a removable edge connector, it should be apparent to those skilled in the art that certain advantages of the invention have been achieved. For example, the use of the leading edge of the circuit board to operatively connect to the host computers, wherein the leading edge comprises a plurality of traces with electrical leads connected to a switching circuit within the apparatus have been illustrated, but it should also be appreciated that various modifications, adaptations, and alternative embodiments thereof may be made within the scope and spirit of the present invention. The invention is solely defined by the following claims.

What is claimed is:

1. A computer management apparatus, comprising:

a cartridge, comprising:

a housing;

a circuit board having an internal portion contained within the housing and a leading edge located outside of the housing;

a switching circuit on the internal portion of the circuit board;

a set of connector ports operatively coupled to the switching circuit; and a cartridge interface that is connected to the housing and at least partially surrounds the leading edge;

an edge connector removably connected to the cartridge interface, the edge connector being operatively coupled to the switching circuit when connected to the cartridge interface, the edge connector comprising a slot adapted to receive the leading edge; and a plurality of cables extending from the edge connector;

wherein the switching circuit switches to connect each set of connector ports to one of the plurality of cables.

2. The apparatus as recited in claim 1, wherein the leading edge comprises a plurality of traces printed thereon, the plurality of traces providing electrical leads to the switching circuit.

3. The apparatus as recited in claim 1, wherein the edge connector further comprises an edge interface for connecting the edge connector to the cartridge interface.

4. The apparatus as recited in claim 3, wherein:

the edge interface comprises at least one threaded screw; and the cartridge interface comprises at least one threaded receptacle for receiving the at least one threaded screw, such that the edge connector is securely connected to the cartridge when the at least one screw is advanced into the at least one receptacle.

5. The apparatus as recited in claim 3, wherein:

the edge interface comprises at least one protrusion; and the cartridge interface comprises at least one receptacle for receiving the at least one protrusion, such that the edge connector is aligned with the cartridge when the at least one protrusion is placed into the at least one receptacle.

6. The apparatus as recited in claim 1, wherein the set of connector ports comprises at least one of a keyboard port to connect to a keyboard, a video port to connect to a display device, and a cursor control port to connect to a cursor control device.

7. The apparatus as recited in claim 6, wherein the set of connector ports further comprises an audio port to connect to an audio device.

8. The apparatus as recited in claim 1, wherein each one of the plurality of cables has a plurality of connector plugs.

9. The apparatus as recited in claim 8, wherein the plurality of cables comprises a first set of computer cables for operatively coupling a first computer to the switching circuit.

10. The apparatus as recited in claim 9, wherein the first set of computer cables comprises a keyboard cable with a keyboard connector plug, a cursor control cable with a cursor control connector plug, and a video cable with a video connector plug.

11. The apparatus as recited in claim 10, wherein the first set of computer cables further comprises an audio cable with an audio connector plug.

12. The apparatus as recited in claim 9, wherein the plurality of cables comprises a second set of computer cables for operatively coupling a second computer to the switching circuit.

13. The apparatus as recited in claim 12, wherein the first set of computer cables corresponds to a first color code and the second set of computer cables corresponds to a second color code.

14. The apparatus as recited in claim 13, wherein the first set of computer cables is identified with the first color code and the second set of computer cables is identified with the second color code.

15. The apparatus as recited in claim 14, further comprising a remote control device removably connected to the cartridge via a remote control connector, the remote control device being operatively coupled to the switching circuit.

16. The apparatus as recited in claim 14, further comprising a remote control device in wireless communication with the switching circuit.

17. The apparatus as recited in claim 13, wherein the edge connector further comprises an edge interface for connecting the edge connector to the cartridge interface, the edge interface identifying the first set of computer cables with the first color code and the second set of computer cables with the second color code.

18. The apparatus as recited in claim 13, wherein the cartridge further comprises an indicator, the indicator indicating the first color code when each set of connector ports are connected to the first set of computer cables, the indicator indicating the second color code when each set of connector ports are connected to the second set of computer cables.

19. The apparatus as recited in claim 1, wherein the plurality of cables run side-by-side along at least a portion of respective lengths beginning at respective proximal ends connected to the edge connector.

20. The apparatus as recited in claim 19, further comprising an extension cartridge connected to respective distal ends of the plurality of cables.

21. The apparatus as recited in claim 20, wherein the extension cartridge comprises an extension circuit board with an extension leading edge.

22. The apparatus as recited in claim 21, further comprising:

an extension connector removably connected to extension cartridge; and a plurality of extension cables extend from the extension connector.

23. The apparatus as recited in claim 22, wherein the extension connector comprises an extension slot adapted to receive the extension leading edge.

24. The apparatus as recited in claim 22, wherein the each one of the plurality of extension cables has a plurality of connector plugs.

25. The apparatus as recited in claim 24, wherein the plurality of extension cables comprises a first set of computer cables for operatively coupling a first computer to the switching circuit.

26. The apparatus as recited in claim 25, wherein the first set of computer cables comprises at least one of a keyboard cable with a keyboard connector plug, a cursor control cable with a cursor control connector plug, and a video cable with a video connector plug.

27. The apparatus as recited in claim 26, wherein the first set of computer cables further comprises an audio cable with an audio connector plug.

28. The apparatus as recited in claim 25, wherein the plurality of extension cables comprises a second set of computer cables for operatively coupling a second computer to the switching circuit.

29. A computer management apparatus, comprising:

a cartridge, comprising:

a housing;

internal circuitry within the housing, the internal circuity comprising a switching circuit;

a set of connector ports operatively coupled to the switching circuit;

external circuity outside of the housing operatively coupled to the internal circuity, the external circuitry comprising a leading edge; and a cartridge interface at least partially surrounding the leading edge;

an edge connector removably connected to the cartridge interface, the edge connector being operatively coupled to the switching circuit when connected to the cartridge interface, the edge connector comprising a slot adapted to receive the leading edge; and a plurality of cables extending from the edge connector;

wherein the switching circuit switches to connect each set of connector ports to one of the plurality of cables.

30. The apparatus as recited in claim 29, wherein the leading edge comprises a plurality of traces printed thereon, the plurality of traces providing electrical leads to the switching circuit.

31. The apparatus as recited in claim 29, wherein the edge connector further comprises an edge interface for connecting the edge connector to the cartridge interface.

32. The apparatus as recited in claim 31, wherein:

the edge interface comprises at least one threaded screw; and the cartridge interface comprises at least one threaded receptacle for receiving the at least one screw, such that the edge connector is securely connected to the cartridge when the at least one screw is advanced into the at least one receptacle.

33. The apparatus as recited in claim 31, wherein:

the edge interface comprises at least one protrusion; and the cartridge interface comprises at least one receptacle for receiving the at least one protrusion, such that the edge connector is aligned with the cartridge when the at least one protrusion is placed into the at least one receptacle.

34. The apparatus as recited in claim 29, wherein the set of connector ports comprises at least one of a keyboard port to connect to a keyboard, a video port to connect to a display device, and a cursor control port to connect to a cursor control device.

35. The apparatus as recited in claim 34, wherein the set of connector ports further comprises an audio port to connect to an audio device.

36. The apparatus as recited in claim 29, wherein each one of the plurality of cables has a plurality of connector plugs.

37. The apparatus as recited in claim 36, wherein the plurality of cables comprises a first set of computer cables for operatively coupling a first computer to the switching circuit.

38. The apparatus as recited in claim 37, wherein the first set of computer cables comprises a keyboard cable with a keyboard connector plug, a cursor control cable with a cursor control connector plug, and a video cable with a video connector plug.

39. The apparatus as recited in claim 38, wherein the first set of computer cables further comprises an audio cable with an audio connector plug.

40. The apparatus as recited in claim 37, wherein the plurality of cables comprises a second set of computer cables for operatively coupling a second computer to the switching circuit.

41. The apparatus as recited in claim 40, wherein the first set of computer cables corresponds to a first color code and the second set of computer cables corresponds to a second color code.

42. The apparatus as recited in claim 41, wherein the first set of computer cables is identified with the first color code and the second set of computer cables is identified with the second color code.

43. The apparatus as recited in claim 42, further comprising a remote control device removably connected to the cartridge via a remote control connector, the remote control device being operatively coupled to the switching circuit.

44. The apparatus as recited in claim 42, further comprising a remote control device in wireless communication with the switching circuit.

45. The apparatus as recited in claim 43, wherein the edge connector further comprises an edge interface for connecting the edge connector to the cartridge interface, the edge interface identifying the first set of computer cables with the first color code and the second set of computer cables with the second color code.

46. The apparatus as recited in claim 43, wherein the cartridge further comprises an indicator, the indicator indicating the first color code when each set of connector ports are connected to the first set of computer cables, the indicator indicating the second color code when each set of connector ports are connected to the second set of computer cables.

47. The apparatus as recited in claim 31, wherein the plurality of cables run side-by-side along at least a portion of respective lengths beginning at respective proximal ends connected to the edge connector.

48. The apparatus as recited in claim 47, further comprising an extension cartridge connected to respective distal ends of the plurality of cables.

49. The apparatus as recited in claim 48, wherein the extension cartridge comprises an extension circuit board with an extension leading edge.

50. The apparatus as recited in claim 49, further comprising:

an extension connector removably connected to extension cartridge; and a plurality of extension cables extend from the extension connector.

51. The apparatus as recited in claim 50, wherein the extension connector comprises an extension slot adapted to receive the extension leading edge.

52. The apparatus as recited in claim 50, wherein the each one of the plurality of extension cables has a plurality of connector plugs.

53. The apparatus as recited in claim 52, wherein the plurality of extension cables comprises a first set of computer cables for operatively coupling a first computer to the switching circuit.

54. The apparatus as recited in claim 53, wherein the first set of computer cables comprises at least one of a keyboard cable with a keyboard connector plug, a cursor control cable with a cursor control connector plug, and a video cable with a video connector plug.

55. The apparatus as recited in claim 54, wherein the first set of computer cables further comprises an audio cable with an audio connector plug.

56. The apparatus as recited in claim 53, wherein the plurality of extension cables comprises a second set of computer cables for operatively coupling a second computer to the switching circuit.

57. A computer management system, comprising:

a cartridge, comprising:

a housing;

a circuit board having an internal portion contained within the housing and a leading edge located outside of the housing;

a switching circuit on the internal portion of the circuit board;

a set of connector ports operatively coupled to the switching circuit; and a cartridge interface that is connected to the housing and at least partially surrounds the leading edge;

an edge connector removably connected to the cartridge interface, the edge connector being operatively coupled to the switching circuit when connected to the cartridge interface, the edge connector comprising a slot adapted to receive the leading edge;

a hub unit operatively coupled to the edge connector; and a plurality of cables removably attached to and extending from the hub unit;

wherein the switching circuit switches to connect each set of connector ports to one of the plurality of cables.

* * * * *